United States Patent [19]

Wang

[11] 4,407,487

[45] Oct. 4, 1983

[54] DEVICE FOR COOLING METAL ARTICLES

[75] Inventor: Robert Wang, Wissous, France

[73] Assignee: Heurtey Metallurgie, Paris, France

[21] Appl. No.: 341,702

[22] Filed: Jan. 22, 1982

Related U.S. Application Data

[62] Division of Ser. No. 112,187, Jan. 15, 1980, Pat. No. 4,329,188.

[51] Int. Cl.[3] ..... C21D 1/667

[52] U.S. Cl. ..... 266/114; 266/113; 266/259; 148/156; 239/428.5

[58] Field of Search ..... 266/113, 114, 259, 299, 266/111, 112; 239/428.5, 431; 148/153, 156, 157

[56] References Cited

U.S. PATENT DOCUMENTS

| | | | |
|---|---|---|---|
| 3,659,928 | 5/1972 | Kunioka et al. | 62/64 |
| 3,693,352 | 9/1972 | Hinze et al. | 62/64 |
| 3,914,135 | 10/1975 | Kozasu | 148/144 |
| 4,065,252 | 12/1977 | Hemsath et al. | 432/77 |
| 4,305,765 | 12/1981 | Wilmotte et al. | 148/156 |

*Primary Examiner*—L. Dewayne Rutledge
*Assistant Examiner*—Christopher W. Brody
*Attorney, Agent, or Firm*—Wenderoth, Lind & Ponack

[57] ABSTRACT

Metal articles are cooled continuously by means of a conical jet of liquid injected into a jet of gas projected at low pressure and high speed onto the articles. The injection is carried out in such a way that particles of liquid are distributed throughout the jet, thus forming a mist which is projected onto the articles. Variable high coefficients of heat exchange are obtained.

7 Claims, 2 Drawing Figures

DEVICE FOR COOLING METAL ARTICLES

This is a division of application Ser. No. 112,187 filed Jan. 15, 1980, now U.S. Pat. No. 4,329,188.

BACKGROUND OF THE INVENTION

The present invention realtes to a method and device for the continuous cooling treatment of metals, especially metallic articles or treated strips especially sheet metal.

In numerous systems of treatment of metals there is used after an appropriate heating cycle a cooling the speed of which determines the final metallurgical structure of the product. This cooling should be adjusted as a function of the dimensions of the articles or strips treated as well as the rate of production of the installation in order to obtain a constant cooling curve.

There have been suggested various systems intended to answer these requirements. Among the known techniques there may be mentioned blowing of air, blowing of a sprayed liquid suspension in air, contact with a jet of liquid, etc.

Each of these systems has faults:

the blowing of air on its own, even in a large quantity, is unsuitable for achieving high coefficients of heat exchange;

the systems in which there is carried out blowing with a suspension of a liquid sprayed in air, even though flexible and effective, from the point of view of heat exchange achieved, generally require large pressures for the carrying gas and are therefore not economical;

the systems using contact with a jet of liquid are very effective with regard to cooling but they cannot operate over a large range of exchange coefficients.

SUMMARY OF THE INVENTION

The device according to the invention is intended to assure the characteristics of cooling which are required, that is high exchange coefficients and the possibility of adjustment over a large range of these coefficients.

The device according to the invention is characterised in that it provides structure for introducing a conical jet of liquid at a position which is carefully chosen into a jet of gas at low pressure projected at high speed on the products to be cooled, the injection being carried out in such a manner that the particles of liquid are distributed within the entire volume of the gaseous jet, forming therein a mist projected onto the products to be cooled.

According to an embodiment of this invention the pressure of the gas, which may be air, is less than 0.15 bars which has the advantage of making it possible to obtain a gaseous jet from a centrifugal fan.

In operating the device according to this invention, the conical jet of liquid, formed by droplets generally having a diameter of the order of 0.8 to 2 mm, injected into the gaseous jet, is taken in charge by the latter and under the effect of friction is broken into droplets which are much finer of the order of 0.05 to 0.2 mm diameter. As indicated above the geometry of the injection is chosen such that the particles of liquid distributed in the gaseous jet form a mist inside the latter. This mist projected on the products to be cooled puts in contact the fine particles of liquid with the very hot surfaces of the product to be cooled, of which the temperature may reach 1100° C. The evaporation which results absorbs the heat and shows itself by very intense heat exchange.

According to the invention there may be used high rates of feed of gas and relatively low rates of feed of liquid. Preferably the gas is charged with liquid in a proportion generally equal to or less than 0.25 kg of liquid per 1 $Nm^3$ of gas. Within these limits and by modifying the rate of feed of liquid, there are obtained coefficients of heat exchange which vary in a ratio of 1:10. Owing to the small content of liquid and by choosing suitably the rates of feed of gas, it is ossible to ensure total evaporation of the drops.

Variation in intensity of cooling may be obtained by modifications of the rate of feed of the liquid or of the rate of feed of the gas, or the two may both be modified simultaneously.

The device of the invention may be inserted in a cooling zone of a treatment installation operating continuously on metallurgical products. The device includes, on both sides of the surfaces of the products to be cooled which are moving continuously, lines either of tubes or of blowing boxes having discharge openings for discharging the gas in the form of conical jets. Each opening is provided with a liquid injector, the injection of liquid in the gaseous jet being carred out so as to obtain an optimal breaking up of the droplets issued from the liquid jet.

The height of an injector with respect to the opening above which it is placed may be equal to the effective diameter of this opening.

The discharge openings may be arranged in lines extending perpendicular to the direction of displacement of the product to be cooled, and the openings of the different lines may be separated one from the others.

The gas may be air and the liquid may be water.

BREIF DESCRIPTION OF THE DRAWINGS

Embodiments of this invention will now be described by way of example with reference to the accompanying drawings wherein:

FIG. 1 is a schematic perspective view of a device according to the invention applied to cooling of continuously moving sheet metal; and FIG. 2 is a schematic view in section of an example of the positioning of an injector relative to its orifice.

DETAILED DESCRIPTION OF THE INVENTION

Figure 1:
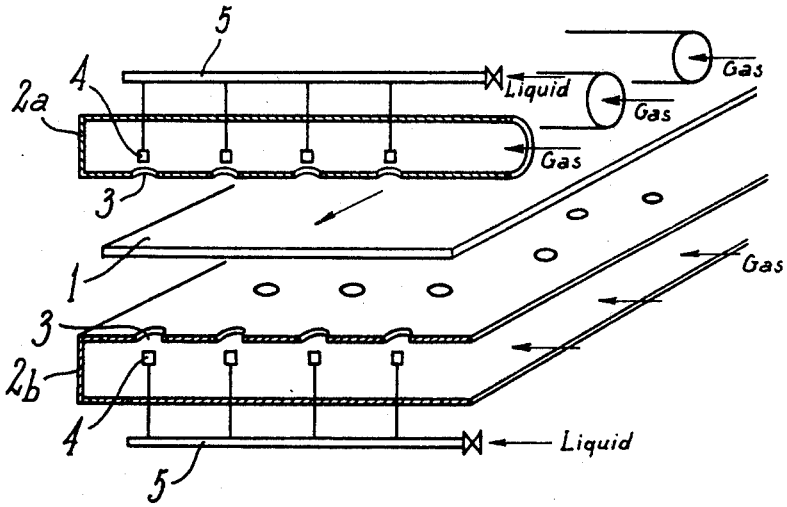

Referring to FIG. 1 it will be seen that a sheet 1 passing in the direction indicated by the arrow traverses a cooling unit formed by a certain number of lines of tubes such as 2*a* or boxes such as 2*b* in which is blown a gas, especially air, at low pressure, using for example a centrifugal fan which is not shown. It will be understood that the cooling systems formed by the tubes and the boxes represent two variants which will not generally exist simultaneously in the same installation. These boxes or tubes are arranged on both sides of the sheet 1. The tubes 2*a* and the boxes 2*b* are provided with a plurality of openings 3 through which the gas is discharged in the form of conical jets. As may be seen in the drawings, each opening 3 is provided with an injector 4 for mechanical spraying of liquid, feed of these injectors being carried out through collectors 5.

The openings 3 are arranged in planes parallel to the sheet and in lines extending perpendicular to the direction of displacement of the sheet to be cooled. The openings on these lines are separated one with respect to the others as is clearly visible in FIG. 1, so as to give improved homogeneity of cooling over the width of the product to be treated, formed here by the sheet 1.

The mist obtained as indicated above by projection of the liquid particles in the whole volume of the gaseous jet is projected on the sheet to be cooled.

Figure 2:
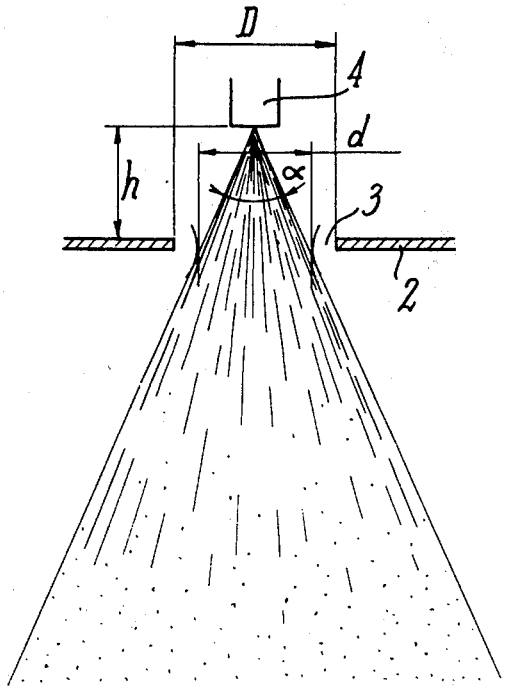

The geometry of injection of the liquid in the gaseous jet is determined in such a manner as to obtain an optimum fractionation of the droplets issued from the liquid jet. Referring to FIG. 2 it is seen that the position of the injector 4 is defined by the distance h separating it from the opening 3 above which it is placed. This distance is, in this embodiment, substantially equal to the effective diameter d of the opening 3, the ratio (d/D) between this diameter and the real diameter D of the opening 3 depending on the profile of this opening.

The effective diameter d is a function of the angle of spray of from the injector 4, this angle being generally close to 30°.

By way of non-limiting example, the other parameters of this installation are as follows:

| | |
|---|---|
| Diameter D the openings | 30 to 100 mm |
| Pressure of gas blown (air) | 200 to 1200 da Pa(2000-12000 $N/m^2$) |
| Liquid pressure (water) | 1 to $7.10^5$ $N/m^2$ |
| Rate of feed of liquid (water) by the injector | 15 to 200 l/h. |

Operating within such limits an installation according to the invention makes it possible to obtain average coefficients of heat exchange situated between 100 and 2000 $W/m^2.°C.$, these coefficients being adjustable in the ratio of 1:10 for a given installation.

Among examples of application of this invention there may be mentioned cooling of strips or heavy plates or slabs or billets.

What is claimed as new is:

1. An apparatus for cooling continuously moving metal articles, said apparatus comprising:

means for projecting conical jets of gas at low pressure toward opposite sides of a continuously moving metal article to be cooled, said projecting means comprising cooling units adapted to be located at opposite sides of the article to be cooled, each said cooling unit having therein a plurality of openings adapted to face the article to be cooled and through which are projected said conical jets of gas; and means for injecting a conical jet of liquid into each respective said conical jet of gas at a position chosen such that liquid particles of each said jet of liquid are broken into finer particles by friction and are distributed into the entire volume of said respective jet of gas, thereby forming therein a mist which is projected onto the article to be cooled, said injecting means comprising a plurality of liquid injectors, each said injector being positioned within a respective said cooling unit at a position spaced inwardly from and aligned exactly with a respective said opening.

2. An apparatus as claimed in claim 1, wherein each said cooling unit comprises a plurality of parallel tubes adapted to extend orthogonal to the direction of movement of the article to be cooled, each said tube having therein spaced said openings.

3. An apparatus as claimed in claim 1, wherein each said cooling unit comprises a box having therein spaced said openings.

4. An apparatus as claimed in claim 1, wherein said openings in each said cooling unit are arranged in parallel rows adapted to extend orthogonal to the direction of movement of the article to be cooled.

5. An apparatus as claimed in claim 4, wherein said openings of adjacent said rows are staggered with respect to each other in the direction of movement of the article to be cooled.

6. An apparatus as claimed in claim 1, wherein said liquid injectors comprise mechanical injectors.

7. An apparatus as claimed in claim 1, wherein each said injector is spaced inwardly from the respective said opening by a distance equal to the effective diameter of said opening occupied by the said jet of liquid passing therethrough.

* * * * *